United States Patent [19]

Stern et al.

[11] Patent Number: 4,655,224

[45] Date of Patent: Apr. 7, 1987

[54] BRASSIERE

[75] Inventors: Harold Stern, Wyckoff, N.J.; Elisabeth Suleiman, Newark, Del.

[73] Assignee: International Playtex, Inc., Stamford, Conn.

[21] Appl. No.: 806,067

[22] Filed: Dec. 6, 1985

[51] Int. Cl.[4] ..... A41C 3/08

[52] U.S. Cl. ..... 128/443; 128/489; 128/491

[58] Field of Search ..... 128/489, 443, 498, 517, 128/510, 500, 474, 483, 491

[56] References Cited

U.S. PATENT DOCUMENTS

| | | | |
|---|---|---|---|
| 2,969,067 | 1/1961 | Smith | 128/489 |
| 2,971,514 | 2/1961 | Steinmetz | 128/464 |
| 3,320,959 | 5/1967 | Fridolph | 128/451 |
| 3,322,127 | 5/1967 | Sachs | 128/483 |
| 3,381,689 | 5/1968 | Sachs | 128/489 |
| 3,392,732 | 7/1968 | Holscher | 128/489 |
| 3,566,878 | 3/1971 | Radomski | 128/498 |
| 3,746,008 | 7/1973 | Lo Cascio | 128/451 |
| 3,817,255 | 6/1974 | Lo Cascio | 128/489 |
| 4,324,254 | 4/1982 | Freedman et al. | 128/494 |
| 4,444,192 | 4/1984 | Stern et al. | 128/491 |
| 4,453,549 | 6/1984 | Di Tullio | 128/491 |
| 4,470,419 | 9/1984 | Di Tullio | 128/491 |

FOREIGN PATENT DOCUMENTS

| | | |
|---|---|---|
| 531810 | 10/1956 | Canada . |
| 1163166 | 9/1969 | United Kingdom . |

*Primary Examiner*—Doris L. Troutman

*Attorney, Agent, or Firm*—Stewart J. Fried; Charles N. J. Ruggiero

[57] ABSTRACT

There is provided a brassiere frame which includes a pair of breast cups each having a upper portion and a lower portion, a pair of dorsal panels each adjacent a different one of the pair of breast cups with each dorsal panel having a side segment adjacent the breast cup and a back segment adjacent the side segment but opposite the breast cup, and a pair of shoulder straps each strap connected to a different one pair of breast cups and respective dorsal panel. The brassiere frame also includes a body band adjacent the lower edge of the frame and connected to the pair of breast cups and the pair of dorsal panels, and a horizontally stretchable, triangular member positioned between the lower portion and a part of the upper portions of the breast cups for connecting together the breast cups and also connected to the body band.

11 Claims, 3 Drawing Figures

BRASSIERE

BACKGROUND OF THE INVENTION

1. Field Of The Invention

This invention relates to brassieres and, more particularly, a brassiere having an improved brassiere frame construction.

An important aspect in a brassiere frame is the ability of the breast cups of the brassiere frame to adjust themselves to the movement of the pectoral muscles and adipose tissue, i.e., the breasts, of a wearer as the breasts vary in size during the wearer's menstrual cycle or move during movements of the wearer, while comfortably maintaining support and shaping. Specifically, should the breast cups of the brassiere fail to adjust properly, they may provide too much restraint which can cause discomfort to the wearer, or too little restraint which can cause inadequate support of the breasts of the wearer. Attempts have been made to achieve the proper restraint in a brassiere frame by either altering the area between the breast cups of the brassiere or by altering the construction of the dorsal panels.

2. Description Of The Prior Art

U.S. Pat. No. 3,322,127 to Sachs, which patent is owned by the assignee of the present application, relates to a brassiere having a triangular piece of material at the lower center of the brassiere frame. The material is a two way elastic powernet material, and is connected to a girthwise stretchable underbust band and between crossing tapes, a portion of each tape being located at the inboard margin of a different one of the pair of breast cups.

U.S. Pat. No. 3,381,689 also to Sachs, which patent is also owned by the assignee of the present invention, relates to a brassiere having a non-stretchable triangular piece of mesh-like fabric at the lower center of the brassiere frame. This brassiere frame also includes the underbust band and crossing tapes feature of the above Sachs patent. However, this patented brassiere provides an elastomeric type action by the bias stretch in the fabric in the girthwise direction due to the underbust band and non-stretchable triangular piece of mesh-like fabric.

U.S. Pat. No. 4,324,254 to Freedman and U.S. Pat. No. 3,817,255 to LoCascio, which latter patent is also assigned to the assignee of the present application, also relate to brassiere frames which have a triangular portion connecting breast cups. These patents provide a single side panel construction.

U.S. Pat. No. 4,470,419 to DiTullio relates to a brassiere which provides for support of and conformance to the wearer by flattening and streamlining the sides of the breast of a full-figured woman by the side panels. Specifically, each side panel consists of two components. The first component is an elongated, angularly disposed, generally triangular shaped member adjacent the breast cup, which component extends from the connection of the shoulder strap to the cup downward to the base of the frame. The second component is connected to the first component and extends about the back of the wearer. The first component stretches basically in the vertical direction, likewise, the second component also stretches basically in the vertical direction. Each of the breast cups are spaced apart and connected together by a central panel, and adjacent and below the lower portion of each breast cup is an underbust band assembly which stretches in the horizontal or girthwise direction. The brassiere of this patent uses the side panels to flatten the sides of breasts of the wearer, thereby necessarily pushing the wearer's breasts forward. This may possibly cause some discomfort and, in any event, emphasizes the breast features of the wearer.

U.S. Pat. No. 2,969,067 to Smith relates to a brassiere which attempts to support the wearer by providing as little restraint as is needed, however, this brassiere has a rather complicated construction. Specifically, the brassiere has a basic V configuration with each breast cup area comprising a breast cup with an upper portion and a lower portion, and a front panel adjacent the lower portion of the breast cup. The front panel of each breast cup is preferably formed of one-way stretch fabric resiliently stretchable in the vertical direction. Adjacent the inboard margin of each breast cup and its respective front panel, there is provided a generally elongated triangular strip. The brassiere frame also includes a side section adjacent the outboard edge of each cup and its respective front panel, and a backband section adjacent the side section. The side section comprises a single piece of one-way stretch elastic material having a series of alternating width bands with the narrow bands having a substantially greater resistance to stretch than the wider bands. The angle of stretch in the side section is substantially 45° to the horizontal lower edge of the side section. Backbands preferably stretch only in the horizontal or girthwise direction. While this patent has some of the key features found in the present invention, such as the side section stretches at an angle of 45°, a back section which provides for girthwise stretch and a breast cup area which provides for vertical stretch although this stretch is due to a separate and distinct front panel, the brassiere of the Smith patent nevertheless has a different construction between the breast cups which construction includes inboard margin elements adjacent each cup. Further, the side section is comprised of bands of material of different width and different stretchability, and still further this brassiere fails to provide an elastic body band along the lower edge of the brassiere frame as is found in the present invention. Thus, this brassiere frame provides a rather cumbersome construction than that of the present invention. Moreover, as stated in Column 1, line 69 etc., the object of this brassiere is to provide restraint and control in the underarm areas of the body thereby providing the desired support.

Other patents provide a brassiere frame having a two component side panel, however they also do not suggest the area between the breast cups construction of the present invention, and moreover their side panel construction is different than that of the present invention.

For example, U.S. Pat. No. 3,746,008 to LoCascio, which patent is also assigned to the assignee of the present application, provides a brassiere having a two component side or dorsal panel. The first component is adjacent the cup portion of the brassiere, and the second component is adjacent the first component. Each component of a side panel stretches in two directions, with the major stretch axis of one component being 45° with respect to the major stretch axis of the second component. However, in this patent, as in the Smith patent, the cups are spaced apart by a center portion. Also, immediately below the lower portion of each breast cup, there is provided an additional front portion.

In U.S. Pat. No. 2,971,514 to Steinmetz, the component adjacent the breast cups is stretchable in the vertical and horizontal direction while the second component adjacent the first component is not stretchable in any direction.

U.S. Pat. No. 3,320,959 to Fridolph provides for a pair of front sections each of which includes a breast cup, side band adjacent each front section and having a rather large lower part, and a shoulder straps adjacent each side band. The side band is stretchable in the horizontal direction, while the shoulder strap, which extends in a sweeping manner to the back of the brassiere, is stretchable in an angular direction.

In U.S. Pat. No. 3,566,878 to Radomski there are three side components, each component having stretchability in two directions which are basically the vertical and horizontal directions of the brassiere frame.

U.S. Pat. No. 3,392,732 to Holscher has a side panel of two components which both stretch in the diagonal direction.

U.K. Patent Specification No. 1,163,166 to Berlei has each side panel made of two components with each component stretchable in two directions. Moreover, this patent provides such a construction for the expressed purpose of avoiding having the back of the brassiere frame ride up the wearer's back.

SUMMARY OF THE INVENTION

It is an object of the present invention to provide a brassiere frame having a relatively simple construction, yet provide cup adjustability to optimize fit and comfort when the cups are on the breasts of a wearer.

It is another object of the present invention to provide a brassiere frame having improved cup adjustability to optimize fit and comfort when the cups are on the breasts of a wearer by altering the construction of both the area between the breast cups and the side panels of the brassiere frame.

It is yet another object of the present invention to provide a brassiere frame having an area between the breast cups or center portion construction as shown in the aforementioned U.S. Pat. No. 3,322,127 to Sachs, and also having a side panel or wing construction which together provide improved comfort, fit, shaping, bust support and cup adjustability in a brassiere frame.

It is a still another object of the present invention to provide a brassiere frame having a side wing and a center portion construction which holds the breasts of the wearer in a cupping fashion, i.e., does not flatten or push forward the breasts of the wearer, even during movements of the wearer.

It is still further object of the present invention to provide a brassiere frame having a side wing which adjusts the cup in response to movements of the wearer and which provides controlled stretching for the cup so that the bust of the wearer is held in a cupping fashion.

These and other objects of the present invention are provided by a brassiere frame having a pair of breast cups connected together at a point with a horizontally stretchable triangular material separating them at the lower base portion of the breast cups, a pair of side or dorsal panels each connected to a different one of the pair of breast cups and having two distinct portions, a pair of shoulder straps each connected at one end to the upper portion of a different one of the pair of breast cups and at the other end to the free end of the respective side panel, and a body band connected along the lower portion of the brassiere frame. The brassiere frame also provides conventional means at the free end of the back portions of the side panel to connect the brassiere frame about the body of the wearer.

Each breast cup has an upper and lower portion. The upper portion is of a non-stretchable material, while the lower portion is made of a material with stretches in the vertical direction. Each side panel comprises two segments, a first or side segment portion adjacent the breast cup and extends from the strap to the body band, and a second or back portion adjacent the side portion. The side portion is relatively thin with respect to its length, and stretches in a diagonal or 45° angle with respect to the portion of the body band it is connected to when measured at the intersection of the body band with the seam line connecting the side segment to the back segment. The second or back segment is made of a material which stretches principally only in the horizontal direction. The triangular portion between the cups, the body band, and the back portion, stretch principally only in the horizontal or girthwise direction thereby providing for direct transmission of forces which minimizes restraints or stresses in the brassiere.

DESCRIPTION OF THE PREFERRED EMBODIMENTS

Figure 1:
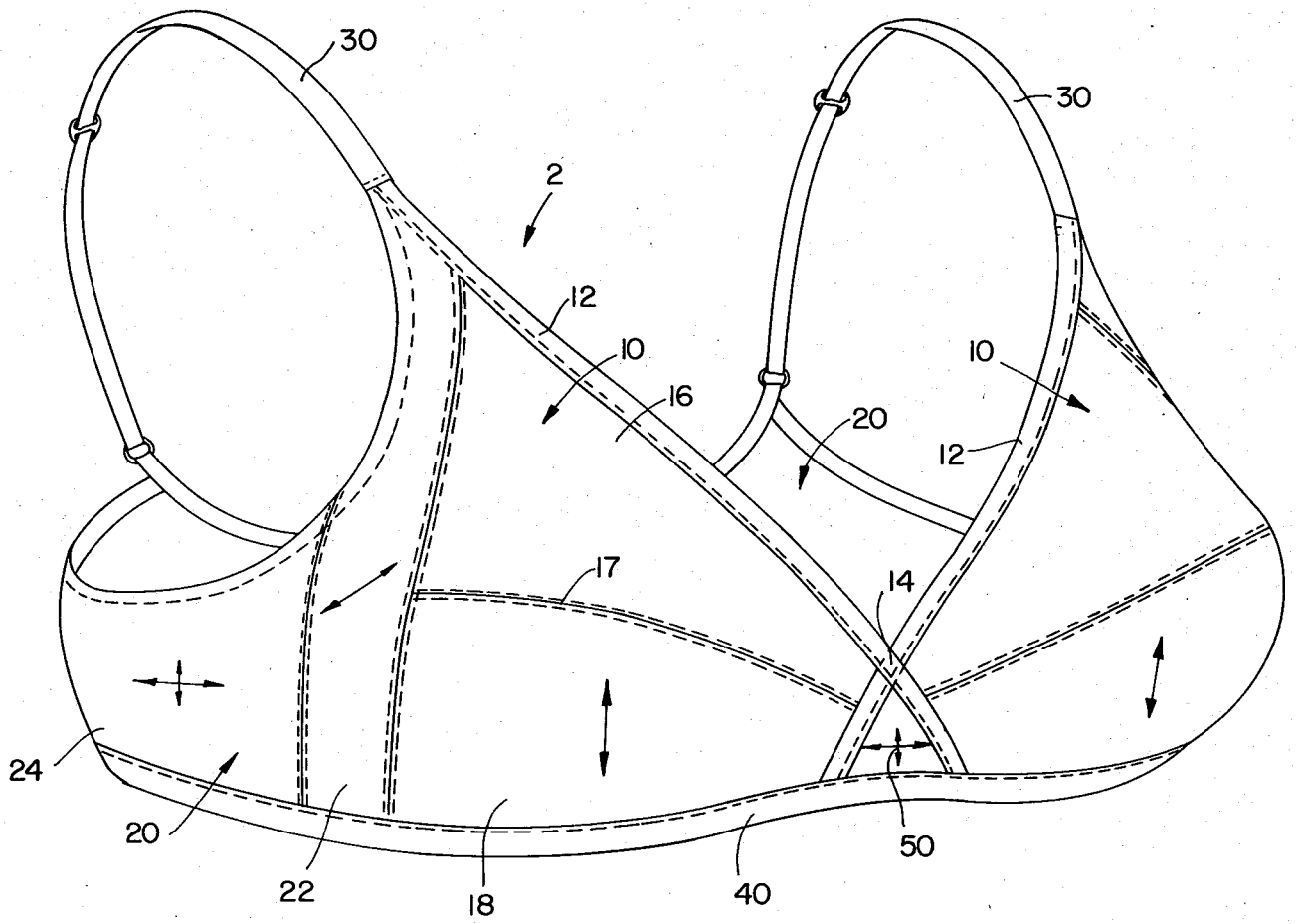
FIG. 1 is a perspective view of the brassiere frame of the present invention.
Figure 2:
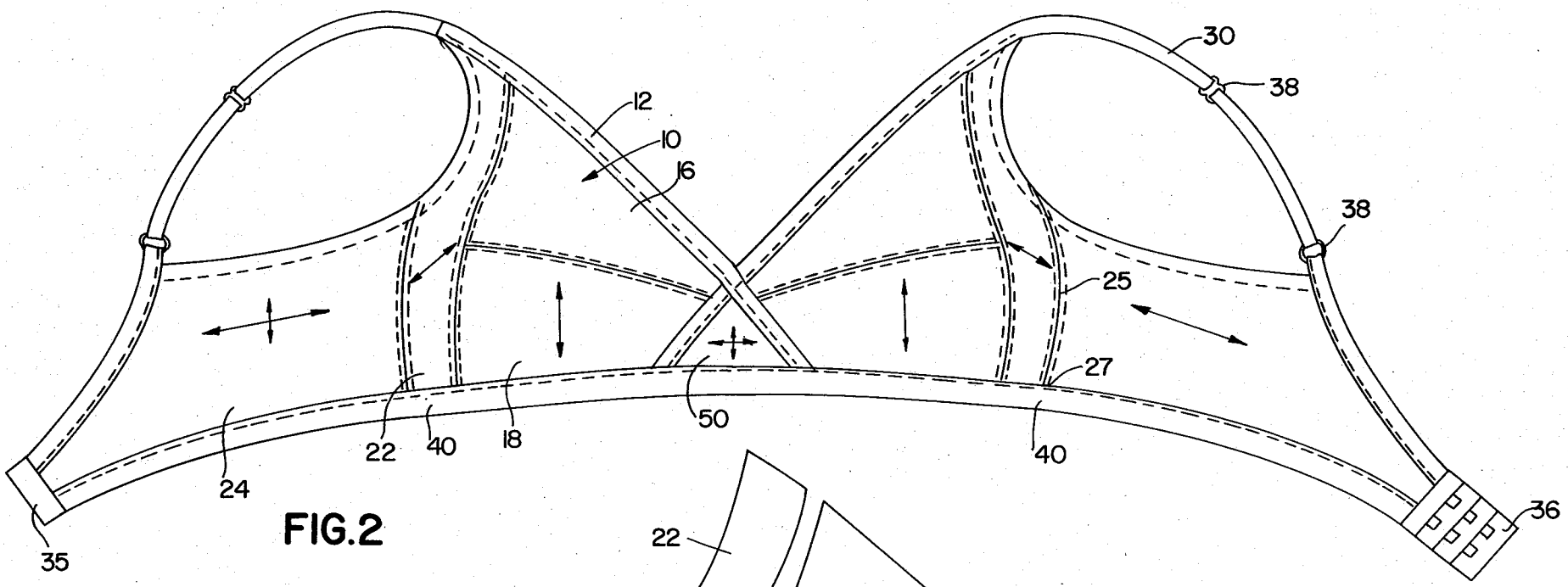
FIG. 2 is a plan view of the brassiere frame of FIG. 1.

Referring to the drawings and more particularly to FIG. 1, a brassiere or brassiere frame generally represented by reference numeral 2, includes a pair of breast receiving cups 10, a pair of side or dorsal panels 20 each adjacent and connected to a different one of the pair of breast receiving cups, a pair of shoulder straps 30 each associated with a different one of the pair of dorsal panels and having conventional length adjusting means 38, and a body encircling band 40 along the entire base or lower edge of the brassiere frame 2. There is also provided at the distal ends of the dorsal panels closure means, preferably, as shown in FIG. 2, in the form of the hook 35 and eye 36 arrangement.

Again referring to FIG. 1, each breast cup 10 has an upper portion 16 and a lower portion 18. Each breast cup 10 can be a single piece molded cup having a distinct upper portion 16 and a distinct lower portion 18 or it can be a two piece cup with the upper and lower portions connected together by a seam 17 or other conventional means in a conventional manner. Starting at shoulder strap 30 and along the inboard margin of each cup 10 is an edge or strip 12. The strips 12 of the cups 10 cross at point 14 which is adjacent the upper portion of each breast cup. Between point 14 and body band 40 and between the breast cups 10, there is provided a triangular member 50. It should be noted that unlike the area between the cups construction illustrated in U.S. Pat. Nos. 3,322,127 and 3,381,689 to Sachs in which the edges or strips of the cups cross at the seam separating the lower and upper portions of the breast cups so that the triangular member is adjacent only the lower portion of the breast cup, point 14 in the present invention is adjacent the lower portion and part of the upper portion of each breast cup analogous to the construction shown in U.S. Pat. No. 3,817,255 to LoCascio.

Each side or dorsal panel 20 of the present invention has at least two components, a side segment 22 and a rear or back segment 24. Side segment 22 is connected to the breast cup 10 along the entire outboard margin of the breast cup 10. Back segment 24 is connected to the edge of the side segment 22 opposite to the breast cup 10.

Conventional means, such as sewn seams, may be used to connect together the components of the brassiere.

Referring to FIG. 2, the upper portion 16 of each breast cup 10 is made of a material which, preferably, does not stretch in any direction, such as a non-stretchable lace. The lower portion 18 of each breast cup 10 is made of a material which stretches, preferably, only in the vertical direction. However, it should be understood that the material used in lower portion 18 may give or even relax somewhat in the horizontal direction. Such a material is tricot. It should be noted that upper portion 16 may possibly relax or give, and that lower portion 18 may even be constructed so as not to stretch vertically provided there is some give or relaxation in the vertical direction.

All of edge 12 does not stretch in any direction. Edge 12 is, preferably, a non-stretchable binding tape covered by lace or a non-stretchable material. By the construction of the breast cups and edges, the upper portion 16 of the breast cups remain rigid, while the lower portion 18 of the breast cups will stretch in the vertical direction but only to a certain extent due to the control of the non-stretchable strips 12.

The triangular member 50 is an elastic member having stretch principally or primarily only in the horizontal or girthwise direction. While the triangular member 50, preferably, has minimal stretch in the vertical direction, alternatively it may not have stretch in the vertical direction provided there is some relaxation or give in the vertical direction. In any event, the stretch in the horizontal direction is substantially many times greater than in the vertical direction. Accordingly, to provide such a feature, an elastic powernet or stretch fabric material is used. Significantly, the horizontal or girthwise directional stretch of triangular member 50 is actually circumferential stretch along the body of the wearer.

The body band 40 is an elastic band which stretches only in the horizontal or body circumferential direction.

Concerning each dorsal panels 20, side segment 22 is made of an elastic powernet material, like triangular member 50, which stretches principally only in one direction and, alternatively, may stretch only in one direction provided it has relaxation or give in the other direction. Significantly, the side segment 22 is constructed so that the principal or, if the alternative is chosen, only stretch is at an angle of approximately 45° degrees with respect to the portion of body band 40 connected to that side segment, i.e., with respect to the horizontal or girthwise direction, when the 45° degree angle or direction is measured at the intersection 27. Intersection 27 is the intersection of the body band 40 and seam line 25 which connects the side segment to its respective back segment 24. Thus, the principal (or only) direction of stretch is that shown by the arrows in FIGS. 2 and 3. This stretching of the side segment 22 is significant since it uniformly stretches the breast cup 10 along the entire outboard margin of the breast cup as the wearer's breast vary in size or shift during movements of the wearer.

Each back segment 24, like triangular member 50, has stretch in the horizontal direction many times greater than in the vertical direction, and also materials may be used which eliminate stretch in the vertical direction provided there is give or relaxation in the vertical direction. Accordingly, each back segment 24 is made of an elastic powernet material like that used for side segment 22 and triangular member 50.

Figure 3:
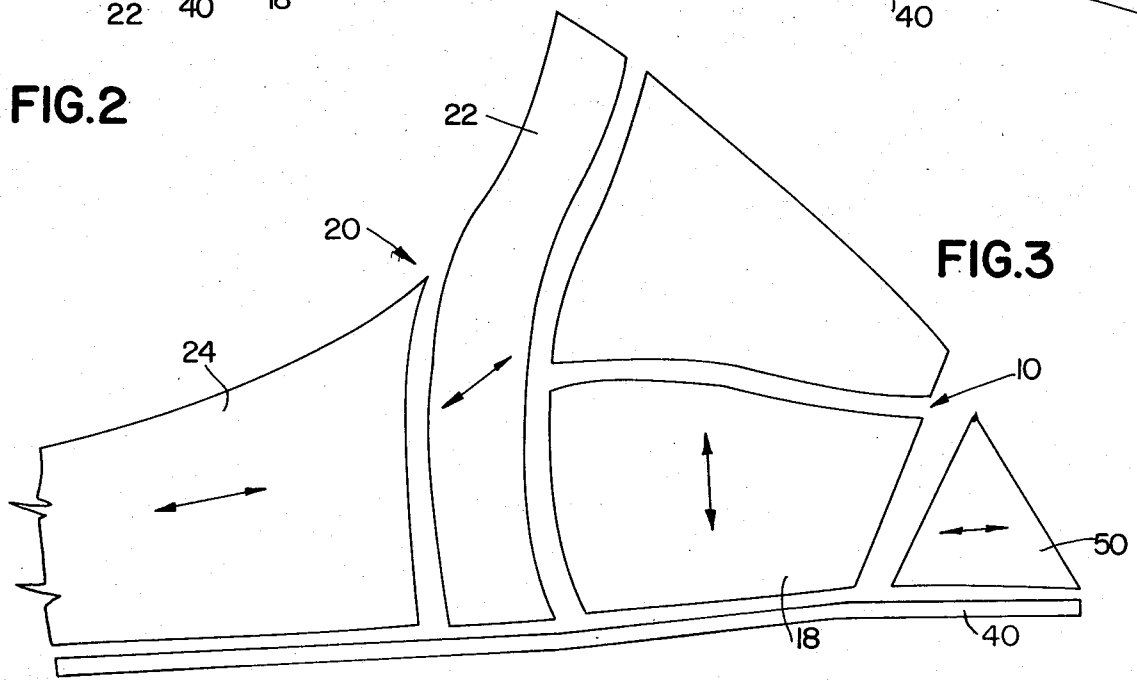
FIG. 3 is an exploded segmental view of the left portion of the brassiere frame of FIG. 2.

Referring to FIG. 3, except for the possible minimal stretch in the vertical direction of triangular member 50 and back segments 24 and in side segment 22 in the direction perpendicular to the principal direction of stretch, the brassiere basically stretches or performs in the following manner. The body band 40 and the triangular member 50, as well as the back segment 24 of each dorsal panel 20, permit the transmission of forces or stretch in the horizontal or girthwise direction, while the lower portion 18 of each breast cup 10 stretches only in the vertical direction. The strip, which separates the vertical stretching, lower portion 18 from the horizontal stretching, triangular member 50, does not stretch in any direction, and therefore acts to maintain the discrete stretching ability of the triangular member and the lower portion.

Each side segment 22 has a diagonal stretch basically uniformly applied along the entire outboard margin of each breast cup 10. While lower portion 18 of each breast cup 10, due to its fabric construction, does not stretch horizontally, it is directly connected to horizontal stretching body band 40 by three needle interlock stitching which provides the functional benefit of give in the horizontal direction in the lower portion of each breast cup. Accordingly, in the area of that connection, lower portion 18 does give in the horizontal direction. Thus, side segment 22 in conjunction with the girthwise or horizontal stretchable triangular member 50 and body band 40, stretches the base of the lower portion 18 of each breast cup 10 to adjust, in a cupping fashion, the breast cup's configuration thereby accommodating changes in or movements of the breast of the wearer. The cupping fashion is basically a shaping of the wearer's breast without placing stress on the sides of the breast which would push the breasts forward and without placing stress at the nipple area or front of the breasts which would flatten the breasts, while providing a fashionable appearance.

Furthermore, the vertical stretchability of lower portion 18 in conjunction with side segment 22, accommodates vertical adjustment to the breast cup that may be needed due to the wearer's movements and due to adjustments made by altering the length of the shoulder strap 30 shown in FIG. 2.

Although certain embodiments have been described and illustrated, modification may be made, as by adding, combining, subdividing parts of substituting equivalents while retaining the advantages and benefits of the present invention which is defined in the following claims.

We claim:

1. A brassiere frame comprising:

a pair of breast cups each having an upper portion and a lower portion;

a triangular member positioned between said lower portions and a part of said upper portions of said breast cups for connecting together said breast cups, said triangular member being made of a material which stretches principally only in the horizontal direction;

a body band along the lower edge of said frame and connected to said pair of breast cups, said triangular member and a pair of dorsal panels;

said pair of dorsal panels each adjacent a different one of said pair of breast cups, each dorsal panel having a discrete side segment adjacent its respective breast cup and having a discrete back segment adjacent said side segment opposite said breast cup with said side and back segments secured together, wherein each side segment stretches principally in a diagonal direction when the diagonal direction is taken at the intersection of said body band and the line of connection of said side segment to its respective back segment;

a pair of shoulder straps each connected to a different one of said pair of breast cups and its respective dorsal panel; and closure means for connecting said dorsal panels about the body of a wearer.

2. The brassiere frame according to claim 1, including a pair of strips each located adjacent the inboard margin of said upper portion of a different one of said pair of breast cups and extending from said shoulder strap to said body band, wherein said pair of strips cross each other at a point adjacent said upper portions of said breast cups.

3. The brassiere frame according to claim 1, wherein said upper portion of each breast cup is non-stretchable.

4. The brassiere frame according to claim 1, wherein said lower portion of each breast cup stretches only in the vertical direction.

5. The brassiere frame according to claim 1, wherein said triangular member stretches only in the horizontal direction.

6. The brassiere frame according to claim 1, wherein said side segment of each dorsal panel stretches only in a diagonal direction when the direction is taken at the intersection of said body band and the line of connection of said side segment with its respective back segment.

7. The brassiere frame according to claim 1, wherein said back segment of each dorsal panel stretches principally in the horizontal direction.

8. The brassiere frame according to claim 1, wherein said back segment of each dorsal panel stretches only in the horizontal direction.

9. The brassiere frame according to claim 1, wherein said body band stretches only in the horizontal direction.

10. The brassiere frame according to claim 2, wherein each of said pair of strips is non-stretchable.

11. A brassiere frame comprising:

a pair of breast cups each having a upper portion and a lower portion, said upper portion being made of a non-stretchable material, said lower portion being stretchable only in the vertical direction;

a pair of dorsal panels each adjacent a different one of said pair of breast cups, each dorsal panel having a side segment adjacent its respective breast cup and having a back segment adjacent said side segment opposite said respective breast cup, said back segment being stretchable principally only in the horizontal direction;

a body band adjacent the lower edge of said frame and connected to said pair of breast cups and said pair of dorsal panels, said body band being stretchable in the horizontal direction, wherein said side segment stretches in a diagonal direction when the diagonal direction is taken at the intersection of said body band and the line of connection of said side segment to its respective back segment;

a pair of shoulder straps each connected to a different one of said pair of breast cups and its respective dorsal panel;

a pair of strips each located adjacent the inboard margin of said upper portion of a different one of said pair of breast cups and extending from said shoulder strap to said body band, wherein said pair of strips cross each other at a point adjacent said upper portions of said breast cups, said strips being non-stretchable;

a triangular member positioned between said pair of breast cups and also between the point where said pair of strips cross and said body band, said triangular band connects together said pair of breast cups, wherein said triangular member stretches only in the horizontal direction; and closure means for connecting said pair of dorsal panels about the body of a wearer.

* * * * *